US005421461A

United States Patent [19]

Ruzic

[11] Patent Number: 5,421,461

[45] Date of Patent: Jun. 6, 1995

[54] PANNING APPARATUS

[76] Inventor: Josef Ruzic, 20 Chartwell Drive, Benowa, Queensland, Australia

[21] Appl. No.: 143,256

[22] Filed: Oct. 29, 1993

[51] Int. Cl.[6] ..... B03B 7/00

[52] U.S. Cl. ..... 209/44; 209/332; 209/437

[58] Field of Search ..... 209/44, 315, 409, 412, 209/443, 437, 446, 508, 331, 332

[56] References Cited

U.S. PATENT DOCUMENTS

| | | | |
|---|---|---|---|
| 1,448,995 | 3/1923 | Dee | 209/437 |
| 2,091,620 | 8/1937 | Williams | 209/44 X |
| 3,232,426 | 2/1966 | Caparrella et al. | 209/44 |
| 3,970,551 | 7/1976 | Wright et al. | 209/437 X |
| 4,319,985 | 3/1982 | Hibbard | 209/44 X |
| 4,371,435 | 2/1983 | Eckersley | 209/508 X |
| 4,543,179 | 9/1985 | Berglund | 209/332 X |

FOREIGN PATENT DOCUMENTS

| | | | |
|---|---|---|---|
| 296631 | 7/1931 | Australia | 209/44 |

*Primary Examiner*—James R. Bidwell
*Assistant Examiner*—Tuan N. Nguyen
*Attorney, Agent, or Firm*—Kimmel, Crowell & Weaver

[57] ABSTRACT

Panning apparatus for separating gold or other minerals or gemstones from soil, gravel or other like materials, the apparatus including a main frame and a secondary frame which supports an upper separating tray assembly and a lower separating pan. The secondary frame is supported for pivotal movement relative to the primary frame and may be oscillated by a motor. A liquid supply tube is arranged to direct water onto the upper tray assembly so that a slurry of materials passes from the upper tray assembly of the lower pan.

22 Claims, 2 Drawing Sheets

PANNING APPARATUS

TECHNICAL FIELD

This invention relates to a panning apparatus which is particularly useful in gold panning applications but which may be used for separation of other metals and mineral including gem stones.

BACKGROUND ART

Gold panning is traditionally carried out by hand using a pan into which a slurry of water, stones and sand are introduced and a motion imparted by hand to the pan with the aim of separating gold particles from the slurry. A similar process may be used for separating gem stones from such a slurry. This procedure is obviously tedious and time consuming and thus some mechanical apparatus have be proposed to simplify the above process. The known panning apparatus however, are sometimes difficult to operate, are of complex construction and do not enable a sufficiently large capacity of gold, mineral or gem bearing soil to be processed per unit time.

SUMMARY OF THE INVENTION

The present invention aims to provide a panning apparatus which alleviates the disadvantages of prior panning apparatus and which enables precious metals or gems to be collected rapidly and efficiently. The present invention also aims in a preferred aspect to provide apparatus which is relatively inexpensive and which may be easily transported by hand. Other objects and advantages of the invention will become apparent hereunder.

The present invention thus provides panning apparatus for separating precious metals and other minerals or gemstones from soil, gravel or the like, said apparatus including primary separating means for receiving said soil, gravel or the like to be treated, secondary separating means for receiving material from said primary separating means, support means for supporting said primary separating means and said secondary separating means for movement with each other, and means for oscillating said support means to cause separation of precious metals and other minerals or gemstones from said soil, gravel or the like.

The panning apparatus in the preferred form of the invention includes primary frame means which is advantageous configured such that the apparatus may rest in an upright position during use. The frame means may present a substantially cuboid shape and preferably the frame means is in the form of a rectangular prism.

The primary frame means preferably includes a plurality of frame members which may be metallic, for example of aluminium, although they may be made or other materials if desired. The frame members may have any desired cross-section, however, preferably the frame members are tubular.

Some of the primary frame members may form ground engaging members. Where the primary frame means is prismatic in shape it is preferred that there be four ground engaging member or legs. The ground engaging members may, when the apparatus is in use, be generally vertically orientated.

Some of the primary frame members which make up the primary frame may form struts or strengthening members. The struts may be arranged to extend between adjacent primary frame members. Preferably the struts extend between adjacent ground engaging members. The struts may extend horizontally between the ground engaging members adjacent their ground engaging ends. A further plurality of struts may be arranged to extend between the distal ends of the ground engaging members.

The primary frame means may include a mounting means to which other parts of the apparatus to be described later may be attached. The mounting means may be provided by a plurality of struts which extend between further opposite struts which extend between the primary frame members. The struts which form the mounting means are preferably located near the groun engaging ends of the ground engaging members. If desired for added rigidity, one or more brace members may be arranged to extend between the struts which form the mounting means. Preferably two brace members are employed.

The panning apparatus also includes a secondary frame means which is suitably coupled to the primary frame means for oscillating movement relative thereto. The secondary frame means may include a plurality of frame members made of any suitable material.

The secondary frame means includes coupling means for securing it to the primary frame means. The coupling means may take any suitable form. The coupling means may be secured to the mounting means of the primary frame means. Preferably the coupling means includes pivot means which may include a sleeve formed of any suitable material. Preferably the sleeve is metallic. The pivot means may include a pivot pin for securing the sleeve to the mounting means of the primary frame means. Preferably the pin extends between the two horizontal struts which form the mounting means, and longitudinally through the sleeve. In this way the sleeve is free to turn about the pin. The pin may be secured to the horizontal struts.

The pivot means further includes a pivot arm which is fixed relative to the sleeve for movement therewith to extend utwardly therefrom. Preferably the pivot arm is attached to the sleeve at a location intermediate the ends of the sleeve. In this way the pivot pin may act as a pivot about which the arm and sleeve may pivot as the arm is moved to and fro.

The secondary frame means further includes a pair of spaced receiving stations for the separating means. Frame members of the secondary frame may provide the receiving stations. The secondary frame means may have a plurality of vertical frame members. The stations may be provided along the substantially vertical frame members. Frame members may form the receiving stations. Alternatively, projections may extend inwardly from desired secondary frame members and these projections may form the stations. The receiving stations preferably enable the separating means to be removable received and supported on planes inclined relative to the secondary frame means and the horizontal plane.

The primary separating means includes soil or gravel receiving means into which gold mineral or gem bearing soil may be deposited. The soil receiving means may be a conveniently shaped receptacle which is fixed in use relative to the secondary frame means.

The planar separating means separates large unwanted objects such as stones for example from the soil or gravel and suitably includes a separating and collecting tray. The tray may include a planar member having a plurality of holes, the size of the holes being such that large unwanted material such as stones will not pass through. Preferably, the holes are about 10 mm in diameter. The holes may extend over a substantial portion of the surface of the member and may be arranged in rows. Suitably the rows have a variable spacing being spaced further apart at the outer end of the planar member. The member is conveniently located spaced from the bottom surface of the tray. Preferably the tray is inclined relative to the horizontal and suitably 10 to 30 degrees to the horizontal. Preferably, the tray is received by one of the receptacle receiving stations of the secondary frame means. The tray may be permanently or releasably secured to the secondary frame means in the receiving station. The tray may be made from any suitable material, however, the tray is suitably formed of a plastics material. The planar member suitably includes at its lower end a trough for collection of some larger stones including gem stones.

A bottom surface of the tray forms a collecting means which collects material which passes through the holes of the planar member. The bottom wall is provided with a funnel-like outlet at its normally lower end through which collected material may pass.

The secondary separating means suitably comprises concentrating means which concentrates material collected by the separating and collecting tray and may be located beneath and spaced from the separating and collecting tray. The concentrating means may be a pan. Preferably, the concentrating pan is also inclined to the horizontal being suitably inclined oppositely to the inclination of the collecting tray and preferably at 10 to 30 degrees to the horizontal. In this way, the outlet of the collecting and separating tray enables material to fall initially onto the higher end of the concentrating tray. The concentrating pan may have side walls and a bottom wall and the side wall at the lower end of the tray may be provided with a series of corrugations. The bottom wall may have a depression or depressions in which the gold minerals or gems may be concentrated. The depressions are preferably located at spaced positions along the bottom wall. The depressions are suitably of trough-like form extending transversely of the pan. One of the depressions may be located at the upper end of the tray and a barrier may be provided forwardly of the depression to improve material collection. The concentrating pan is mounted on the secondary frame means and preferably the pan is received by one of the receiving stations. The concentrating pan is preferably releasably mounted in the receiving station. The pan may be made of any suitably material. The pan may be metallic or may be made of a plastics material if desired.

The panning apparatus also preferably includes washing liquid supply means. The liquid supply means suitably sprays or directs liquid such as water, for example onto soil or gravel placed into the separating means. The liquid supply means provides water for washing soil along the bottom surface of the tray through the outlet therein. The water is also used to wash larger materials over the planar member. The liquid supply means may be a spray means for spraying water over and onto the tray. The spray means may be a conduit with a plurality of apertures for directing water over and onto the pan. The conduit may be attached to the secondary frame means. Preferably the conduit is secured between the upper ends of the two upstanding frame members of the secondary frame means. The liquid travels down the tray, through the outlet and onto the concentrating pan. The conduit may be coupled to a water supply such as a mains water supply or to a pump which may be associated with a reservoir of water. The pump may be arranged to recirculate water thorugh the apparatus.

The panning apparatus includes drive means for oscillating the secondary frame means. The drive means may osicllate the frame means so that it moves to and fro at a rate which enables the deposited soil to be processed by the panning apparatus. Preferably the drive means oscillates the secondary frame at a rate of about 180 oscillations per minute. The drive means may take any suitable form, however, preferably the drive means includes a drive motor. The motor may be an electric motor although a hydraulic or penumatic motor may also be employed. The motor may be directly coupled to the secondary frame means. It is preferred, however, that the motor be coupled to the secondary frame means via a gear box. The gearbox may be attached to the pivot arm of the secondary frame means via a crank and link. By moving this arm to and fro the drive means causes the secondary frame means to oscillate relative to the primary frame means. For convenience, the drive means may be mounted to the primary frame means.

BRIEF DESCRIPTION OF THE DRAWINGS

A particularly preferred form of the invention will now be described by way of example with reference to the accompanying drawings and wherein.

DESCRIPTION OF THE PREFERRED EMBODIMENT

Figure 1:
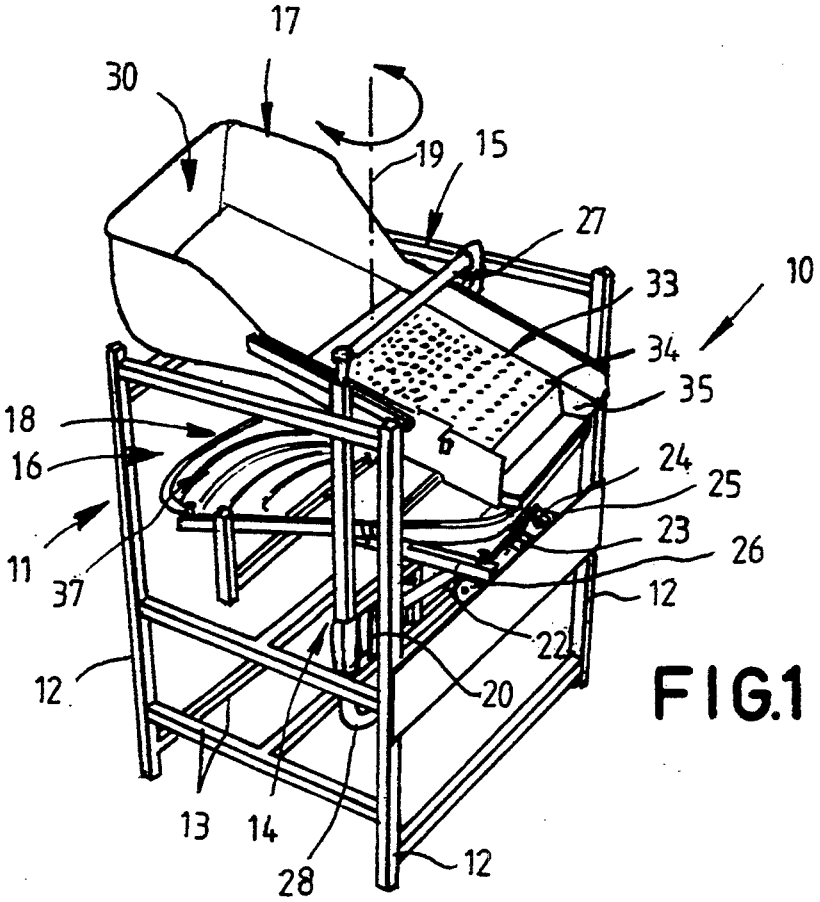
FIGS. 1 and 2 are isometric views of the apparatus from the top and one side respectively.
Figure 2:
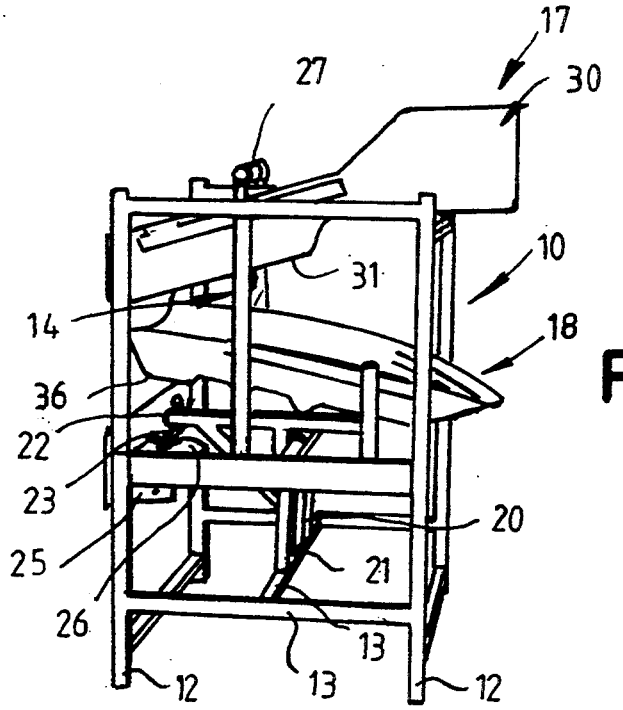
Figure 3:
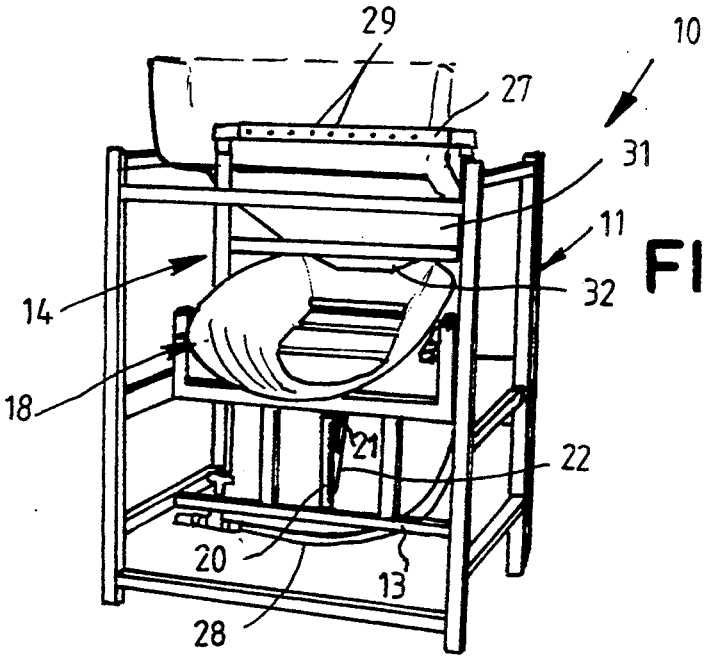
FIG. 3 is a rear view of the apparatus with the top tray partly cut away.
Figure 4:
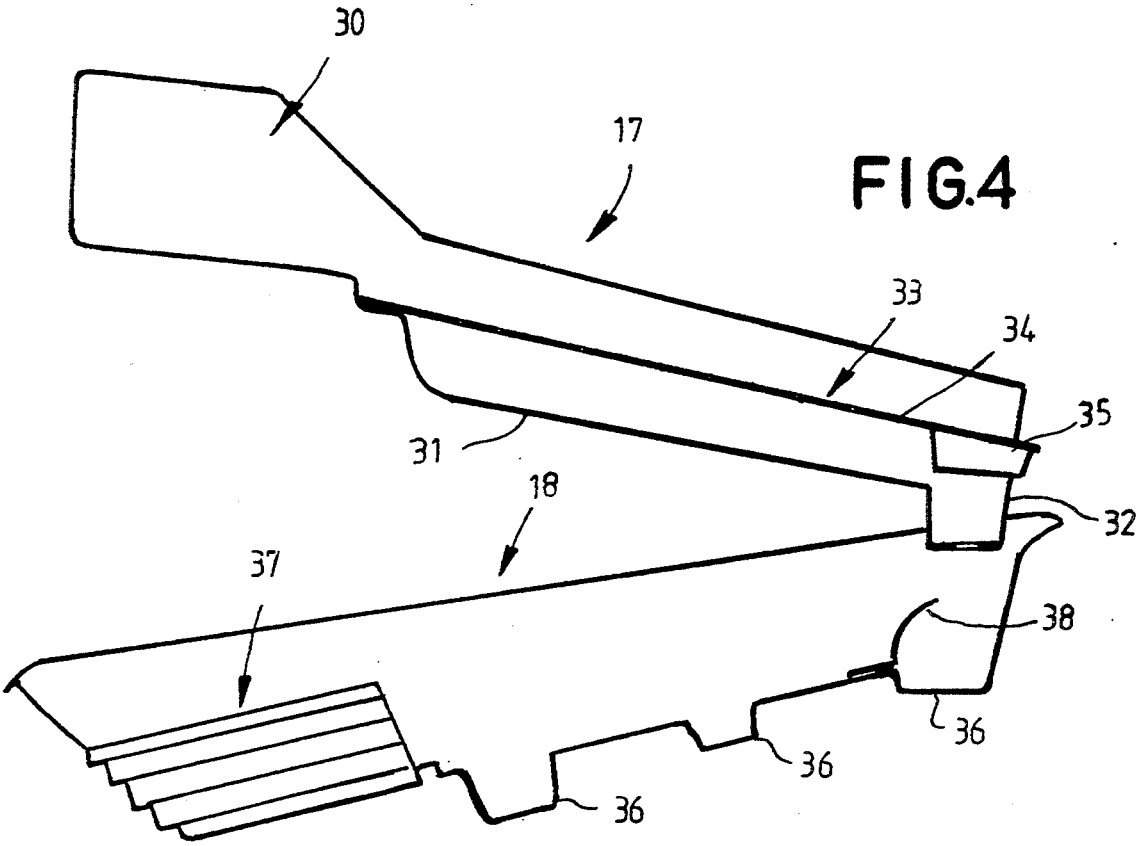
FIG. 4 is a cross sectional view of the dirt receiving and concentrating trays or pans.

Referring to the drawings there is illustrated gold panning apparatus 10 according to the present invention comprising a primary frame 11 which includes in this instance four upstanding legs 12 and cross-members 13 forming a generally rectangular frame. Supported for oscillating movement relative to the frame 11 is a secondary frame 14 which includes upper and lower pan or tray receiving stations 15 and 16 for receiving and supporting a first separating tray assembly 17 and a concentrating tray or pan 18.

The secondary frame 14 is mounted to the primary frame 11 for pivotal movement about a substantially vertical axis 19 defined by a sleeve 20 supported rotatably on a pivot pin 21 which extends between a pair of cross members 13 of the primary frame 11. The pivotal axis defined by the pivot pin 21 and sleeve 20 preferably is arranged centrally of the tray assembly 17 and concentrating pan 18 so that maximum oscillation of the tray assembly and pan occurs at their extremities. The secondary frame 14 further includes an actuating arm 22 extending outwardly from the sleeve 20 and which is pivotally connected at its free end to one end of a link 23, the opposite end of which is pivotally connected to a crank arm 24 of a gear box 25 which is driven by an electric drive motor 26. Thus when the motor 26 is driven the crank arm 24 will be caused to rotate and transmit through the link 23 an oscillating motion to the arm 22 and thus the secondary frame 14 about the axis 19.

The secondary frame 14 further supports adjacent the upper station 15 is a liquid delivery tube 27 which is connected to a water supply via a duct 28 which passes through one of the upright frame members of the secondary frame 14. The tube 27 is provided with a plurality of apertures 29 through which water may exit. The rotational attitude of the member 27 may be varied so as to vary the direction of water supply from the apertures 29 as described further below.

Supported releasably in the upper station 15 is a downwardly inclined tray assembly 17 which includes a rearward material receiving portion 30 and a bottom wall 31 which terminates in a central funnel shaped outlet 32 at the lower portion of the tray assembly 17. Supported above the bottom wall 31 and extending substantially parallel thereto as an extension of the base of the material receiving portion 30 is a planar member 33 provided with a series of holes 34 which serve to prevent passage of larger particles through the member 33. The holes 34 are arranged in rows, the rows being more closely spaced at the upper end of the member 33. The member 33 also includes at its lower end a transversely extending trough 35 for collection of larger stones, gems or nuggets.

Arranged at the second station 16 is the concentrating tray or pan 18 which has a series of three trough-like depressions 36 of different depth for collecting particles of gold or gems or other minerals of different sizes. The tray or pan 18 is inclined as shown opposite the inclination of the tray assembly 17 and provided in its wall at its lower end with a series of corrugations 37 which serve to collect smaller particles of gold, minerals or gems.

A raised arcuate barrier or shield 38 is disposed at the lower side of the upper depression 36 to maintain heavier stones or the like in the depression 36. The pivot axis 19 of the frame 14 is preferably arranged centrally of the tray assembly 17 and pan 18 and passes therethrough for a purpose which will hereinafter become apparent.

In use the motor 26 is operated to impart an oscillating motion to the secondary frame 17 and thus the tray 17 and pan 18. Soil, gravel or other materials are deposited into the upper portion 30 of the tray 17 and water directed through the apertures 29 in the tube 27 towards the material in the portion 30 so as to wash a slurry of material down over the member 33. Soil particles and other material sufficiently small in size fall through the holes 34 and pass via the outlet 32 onto the lower tray 18. Larger particles are simple washed over the end of the member 33 or collected in the trough 35. The material then undergoes in the pan 18 further separation and concentration such that gold or other minerals of heavier weight or gems will collect in the depressions 36 and/or corrugations 37. At intervals the tray 18 may be removed from the secondary frame 14 and panned in the usual way to achieve final separation. The pipe 27 may be twisted so as to direct the water from the holes as desired to any region of the tray 17 so as to ensure that all material will pass down the tray 17.

Maximum oscillation occurs at opposite ends of the trays 17 and pan 18 so that the material at those ends will rapidly pass either from the end of the tray or towards the centre of the tray where it is concentrated and collected. Minimum oxicillations occur at the centre of the trays so that gold particles or other separated materials can be efficiently collected. The apparatus 10, if desired may be placed into a large container so that water run off from the trays can be collected and recycled through the tube 27. For this purpose the duct 28 may be connected to a pump which communicate with water collecting in the container and the pump which may be a submergible pump located in the container. The motor 26 is preferably battery driven and may in some instances be solar powered or be driven by batteries which are solar charged.

It will be appreciated that the configuration of the apparatus as shown and described may be considerably varied. For example the primary frame 11 may be constructed of plastics as may the secondary frame 14. The liquid outlet tube 27 may if desired be replaced by a single spray nozzle and the separating tray assembly 17 and concentrating pan 18 may be designed to be of any suitable configuration.

Whilst the above has been given by way of illustrative embodiment of the invention, all such modifications and variations thereto as would be apparent to persons skilled in the art are deemed to fall within the broad scope and ambit of the invention as herein defined in the appended claims.

I claim:

1. Panning apparatus for separating minerals and gemstones from soil or gravel, said apparatus including inclined primary separating means for receiving said soil or gravel to be treated, inclined secondary separating means for receiving material from said primary separating means, support means for supporting said primary separating means and said secondary separating means for movement with each other, means for supporting said support means for rotation about a substantially vertical axis, said axis being arranged centrally of said primary and second separating means and means for oscillating said support means in opposite directions about said axis, said secondary separating means having first collection means at its upper end for collection of gemstones and second collection means at its lower end for collection of minerals upon oscillation of said support means.

2. Panning apparatus according to claim 1 wherein the axis of oscillation of said support means is arranged substantially centrally of said primary and secondary separating means.

3. Panning apparatus according to claim 1 and including primary frame means and secondary frame means supported pivotally on said primary frame means for movement about said axis, said secondary frame means comprising said support means for said primary and secondary separating means.

4. Panning apparatus according to claim 1 wherein said oscillating means comprises drive motor means supported on said primary frame means and coupled to said secondary frame means so as to cause oscillation theeof.

5. Panning apparatus according to claim 4 wherein said secondary frame means includes first and second receiving stations for releasably receiving said primary and secondary separating means.

6. Panning apparatus according to claim 5 wherein said receiving stations support their associated separating means at an inclination to the horizontal whereby the inclination of said primary separating means is opposite the inclination of said secondary separating means.

7. Panning apparatus according to claim 1 and including liquid supply means for supplying liquid to said primary separating means.

8. Panning apparatus according to claim 7 wherein said liquid supply means comprises an apertured tube extending transversely of said primary separating means, said apertured tube being adpated to direct liquid onto materials to be separated in said primary separating means.

9. Panning apparatus according to claim 7 wherein said liquid supply means is mounted on said secondary frame means.

10. Panning apparatus according to claim 1 wherein said primary separating means includes a material receiving portion at the operative upper end thereof and an adjacent separating portion.

11. Panning apparatus according to claim 10 wherein said primary separating means is in the form of a tray, said tray having an outlet at its operative lower end for directing liquid and materials onto said secondary separating means.

12. Panning apparatus according to claim 10 wherein said separating portion comprises an apertured member disposed above a base portion of said tray for preventing larger particles from passing to said base portin of said tray.

13. Panning apparatus according to claim 12 wherein said apertured member includes a collecting trough at its operative lower end for collecting large stones, gems or nuggets.

14. Panning apparatus according to claim 1 wherein said secondary separating means comprises a pan provided with a plurality of transversely extending depressions for collecting materials therein.

15. Panning apparatus according to claim 14 wherein said pan is provided with corrugations at its lower end.

16. An apparatus for separating minerals and gemstones, said apparatus including an inclined primary separating tray assembly, an inclined secondary separating tray assembly, support means for supporting said primary separating tray assembly above said secondary separating tray assembly, the inclination of said primary separating tray assembly being opposite the inclination of said secondary separating tray assembly whereby said secondary separating tray assembly receives at it upper end, materials from the lower end of said primary tray assembly, said secondary tray assembly including adjacent its upper end a transversely extending barrier of arcuate cross-sectional form for trapping gemstones in said secondary separating tray assembly, said support means being mounted for rotational movement about a substantially vertical axis, said axis passing centrally through said primary and secondary separating tray assemblies and means for causing oscillation of said support means and thus said primary and secondary tray assemblies in opposite directions about said axis so as to cause separation of said minerals and gemstones.

17. Apparatus according to claim 16 wherein said secondary tray assembly includes a plurality of transverse depressions, said barrier being disposed forwardly of one of said transverse depressions.

18. Apparatus according to claim 16 wherein said secondary tray assembly is provided at its lower end with a series of corrugations.

19. Apparatus according to claim 18 wherein said secondary tray assembly is removable from said apparatus to allow for hand panning.

20. Mineral and gemstones separation apparatus, said apparatus including an inclined primary separating tray assembly, an inclined secondary separating tray assembly, support means for supporting said primary separating tray assembly above said secondary separating tray assembly, the inclination of said primary separating tray assembly being opposite the inclination of said secondary separating tray assembly whereby said secondary separating tray assembly receives at its upper end, materials from the lower end of said primary tray assembly, said support means being mounted for rotational movement about a substantially vertical axis, said axis passing centrally through said primary and secondary separating tray assemblies and means for causing oscillation of said support means and thus said primary and secondary tray assemblies in opposite directions about said axis, said secondary separating tray assembly comprising a tray having a transverse barrier at its upper end rearwardly of which gemstones collect and a series of corrugations at its lower end for collection of minerals, said secondary tray assembly being detachable from said apparatus to allow for hand panning.

21. Separating apparatus according to claim 20 wherein said secondary tray assembly has a bottom wall and side walls, said corrugations being formed in said side wall at the lower end of said tray assembly.

22. Separating apparatus according to claim 21 wherein said bottom wall is provided with spaced apart transverse depressions.

* * * * *